US006768072B1

(12) United States Patent
Yang

(10) Patent No.: US 6,768,072 B1
(45) Date of Patent: Jul. 27, 2004

(54) MULTI-DIRECTIONAL GRIP SWITCH LAMP SOCKET

(75) Inventor: Wen Ho Yang, Taipei Hsien (TW)

(73) Assignee: Sun Lite Sockets Industry, Inc., Taoyun Hsien (TW)

( * ) Notice: Subject to any disclaimer, the term of this patent is extended or adjusted under 35 U.S.C. 154(b) by 0 days.

(21) Appl. No.: 10/725,499

(22) Filed: Dec. 3, 2003

(51) Int. Cl.[7] ..... H01H 13/00; H01H 3/00

(52) U.S. Cl. ..... 200/329; 200/320; 200/463; 439/620; 439/638

(58) Field of Search ..... 200/329, 320, 200/410, 421, 440, 463; 439/620, 666, 667, 638, 641

(56) References Cited

U.S. PATENT DOCUMENTS 4,241,249 A * 12/1980 Chundelak, Jr. ..... 200/331
4,842,556 A * 6/1989 Vogel ..... 439/638
5,783,788 A * 7/1998 Jones et al. ..... 200/51.17
5,823,322 A * 10/1998 Johnson ..... 200/51.17
6,201,201 B1 * 3/2001 Wu ..... 200/405
6,227,912 B1 * 5/2001 Hung ..... 439/620
6,423,919 B1 * 7/2002 Liao et al. ..... 200/543

* cited by examiner

*Primary Examiner*—Kyung Lee
(74) *Attorney, Agent, or Firm*—Bacon & Thomas PLLC

(57) ABSTRACT

A multi-directional switch grip includes an insulating body, a lamp socket and an insulating disc positioned between the insulating body and the lamp socket. A pair of terminals, an intermediate contact member and a rotating member with a ratchet respectively on two sides is fixed in the insulating body. A conductive member fits around a large ratchet and has half numbers of contact pieces as that of the large ratchet. One of the terminals and the intermediate contact member contact the teeth of the large ratchet in a turned off condition, or contact the contact pieces in a turned-on condition. A switch grip is provided to be pulled or bent in any direction to move a hooking member, which moves and rotates the large ratchet for a set angle to turn on the switch and the switch is turned off by repeating the same action.

3 Claims, 4 Drawing Sheets

B

A

MULTI-DIRECTIONAL GRIP SWITCH LAMP SOCKET

BACKGROUND OF THE INVENTION

1. Field of the Invention

This invention relates to a multi-directional grip switch lamp socket, particularly to one movable to any direction for turning on and off the switch of a lamp socket, convenient to handle.

2. Description of the Prior Art

There are three conventional kinds of lamp sockets having different switches classified into a knob switch lamp socket, a pusher switch lamp socket, and a lamp socket with a pull string.

The knob switch lamp socket disclosed in the U.S. Pat. No. 4,936,777 includes a switch handle to be rotated for carrying out turning on and off to light up or turn off a lamp. If the switch handle is rotated clockwise for a set angle, the power is through to light up the lamp, and the power is to be cut off by the same action of rotating the switch handle clockwise for a set angle further. Thus its operable direction is definite.

The pusher switch lamp socket disclosed in the U.S. Pat. No. 6,010,355 includes a handle to be pulled laterally to turn on and off the power. If the handle it pushed forward, the switch is turned on, and if the handle is pushed in the reverse direction laterally, the switch is turned off. Thus this pusher switch lamp socket is also operable in the definite direction only.

The lamp socket with a pull string disclosed in the U.S. Pat. No. 6,186,822 includes a long string for controlling a switch positioned in the lamp socket. A first pulling of the string can turn on the switch, and a second pulling of the string can turn off the switch. So this lamp socket with a pull string can carry out turning on and off by only repeating pulling down the string.

Those three conventional switch lamp sockets all have a definite set direction for turning on and off the switch, so they are not so convenient for users (or consumers), if users do not know their operable direction beforehand.

SUMMARY OF THE INVENTION

This invention has been devised to offer a multi-directional grip switch lamp socket, convenient for handling.

BRIEF DESCRIPTION OF DRAWINGS

This invention will be better understood by referring to the accompanying drawings, wherein.

DETAILED DESCRIPTION OF THE PREFERRED EMBODIMENT

Figures 1, 2:
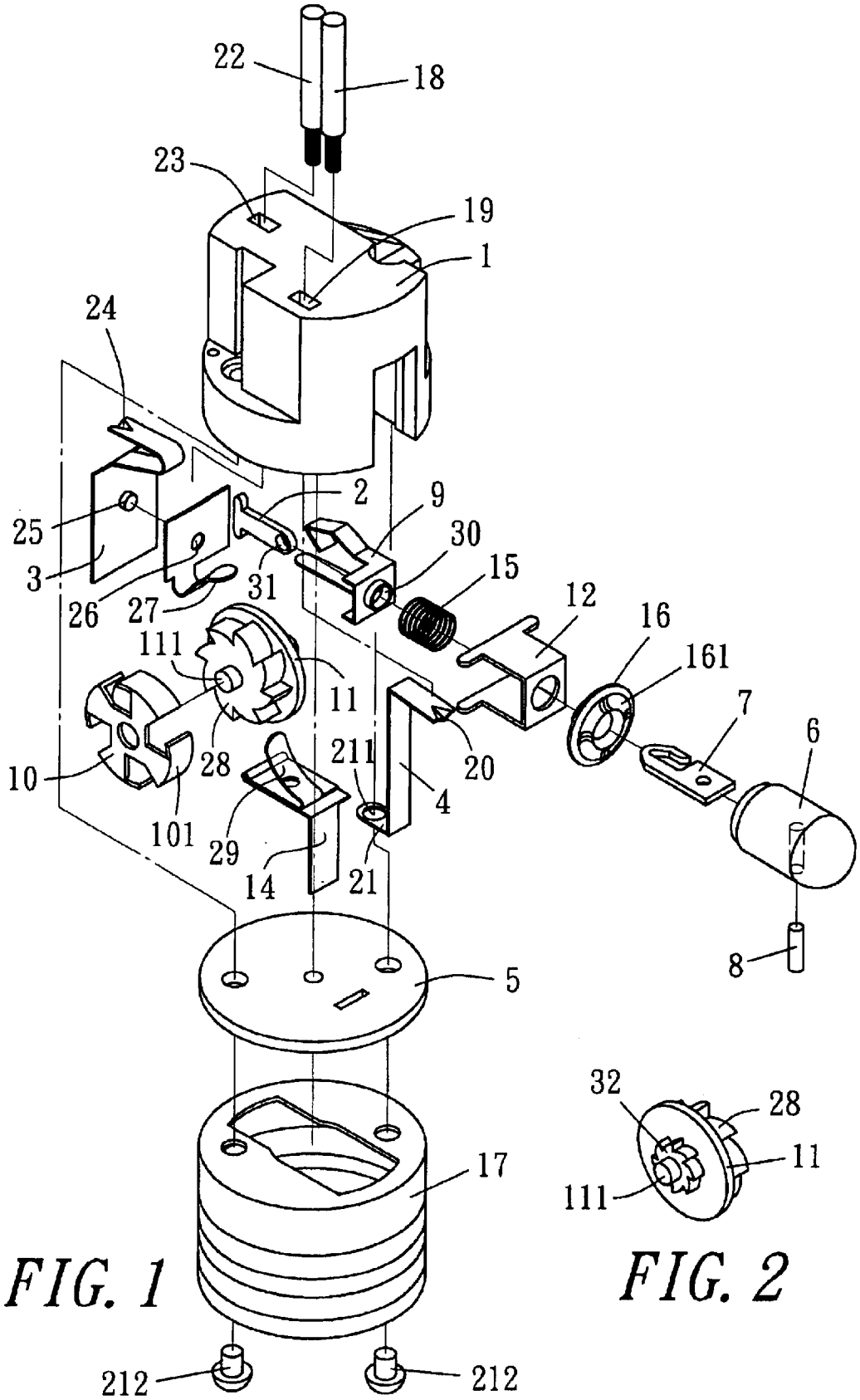
FIG. 1 is an exploded perspective view of a multi-directional grip switch lamp socket in the present invention.
FIG. 2 is a perspective view of a rotating member in the present invention.

A preferred embodiment of a multi-directional grip switch lamp socket in the present invention, as shown in FIG. 1, includes an insulating body 1, a metal lamp socket 17 and an insulating disc positioned between the insulating body 1 and the lamp socket 17.

The insulating body 1 is made of insulating material such as bakelite, having an interior hollow opening to the bottom, two wire holes 19, 23 for two wires 18, 22 to insert therein, and two terminals 3, 4 to be placed in the hollow of the insulating body 1 to face the two wire holes 19, 23 to connect with the two wires 18, 22.

Further, a rotatable member 11 is positioned in the interior hollow of the insulating body 1, made of insulating material, having a large ratchet 28 rotatably fixed on one side and a small ratchet 32 on the other side in a corresponding way, as shown in FIG. 2, a projecting shaft 111 extending from the center of the rotatable member 11 to its both sides and fitting in an inner hole (not shown) in the interior hollow to let the rotatable member 11 to rotate freely with the projecting shaft 111. The large ratchet 28 and the small ratchet 32 both made of insulating material have even numbers (eight shown in Figures for example in the invention) of ratchet teeth, and further a metal conductor 10 is provided to fit around the outer circumference of the large ratchet 28, having the half number (four shown in an example) of contact pieces 101 spaced apart equidistantly in its outer circumference as that of the ratchet teeth of the large ratchet 28. The large ratchet 28 has their ratchet teeth spaced apart and intermittently covered by the contact pieces 101.

The terminal 4 has its connect end 21 bored with a hole 211 for a rivet 212 to fit through to firmly connect the terminal 4 with the lamp socket 17.

Further, a intermediate contact member 14 is provided under the large ratchet 28 of the rotatable member 11, passing through a hole of the insulating disc 5 to reach the interior of the lamp socket to contact with a terminal of the lamp (not shown), and having a elastically pressing plate 29 bent toward the large ratchet 28 and elastically contact on either one of the ratchet teeth of the large ratchet 28 or one of the contact pieces 1101 of the conducting member 10.

The terminal 3 also has an elastically pressing plate 27 bent toward the large ratchet 28 and elastically urging on either one of the ratchet teeth of the large ratchet 28 or one of the contact pieces 101 of the conductive member 10. Further, the terminal 3 has a projection 25 for a connect hole 26 of the elastically pressing plate 27 to fit with, letting the terminal 3, the intermediate contact member 14 and the large ratchet 28 electrically communicating with one another Further, a hooking member 9 is provided, positioned in the interior hollow of the insulating body 1, having an front end hooking one of the teeth of the small ratchet 32, and a through hole 30 for a T-shaped rod 2 to pass through. The T-shaped rod 2 has a hook hole 31 formed in its end.

Further, a switch grip 6 is provided, positioned outside of the insulating body 1, and a hook 7 is secured in the switch grip 6 with a pin 6, so the pull rod 2 orderly passes through the through hole of the hooking member 9, a spring 15, a fix base 12 and a guide ring 16, with the hook 7 hooking the hook hole 31 of the pulling rod 2. Then the switch grip 6 can pull the hooking member 9 to move laterally. The spring 15 is firmly secured in the fix base 12, having two ends respectively urging the hooking member 9 and the guide ring 16. The guide ring 16 has a recessed surface 161 for the inner end of the switch grip 6 to fit therein.

Figure 3:
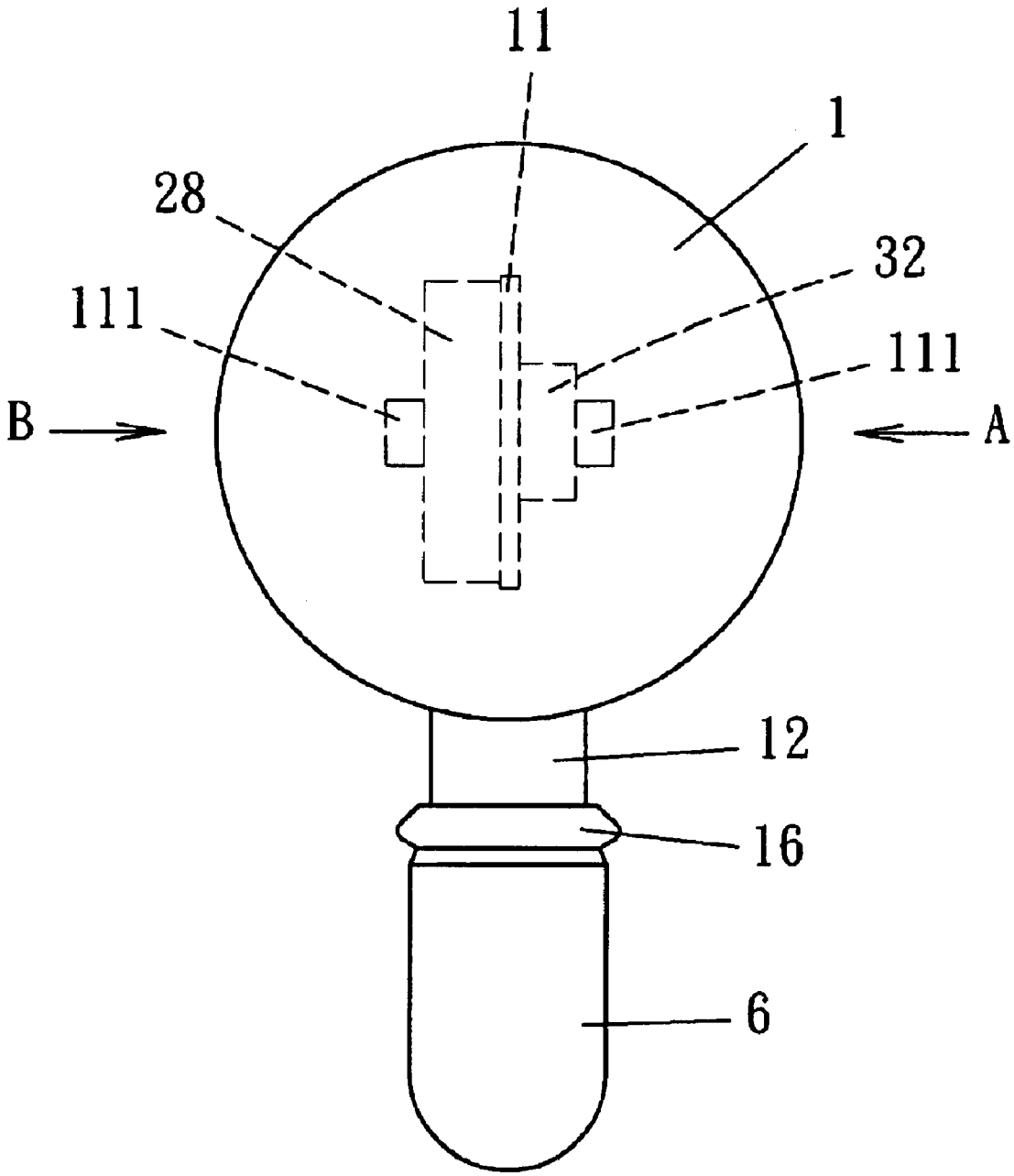
FIG. 3 is an upper view of the multi-directional grip switch lamp socket in the present invention.
Figure 5:
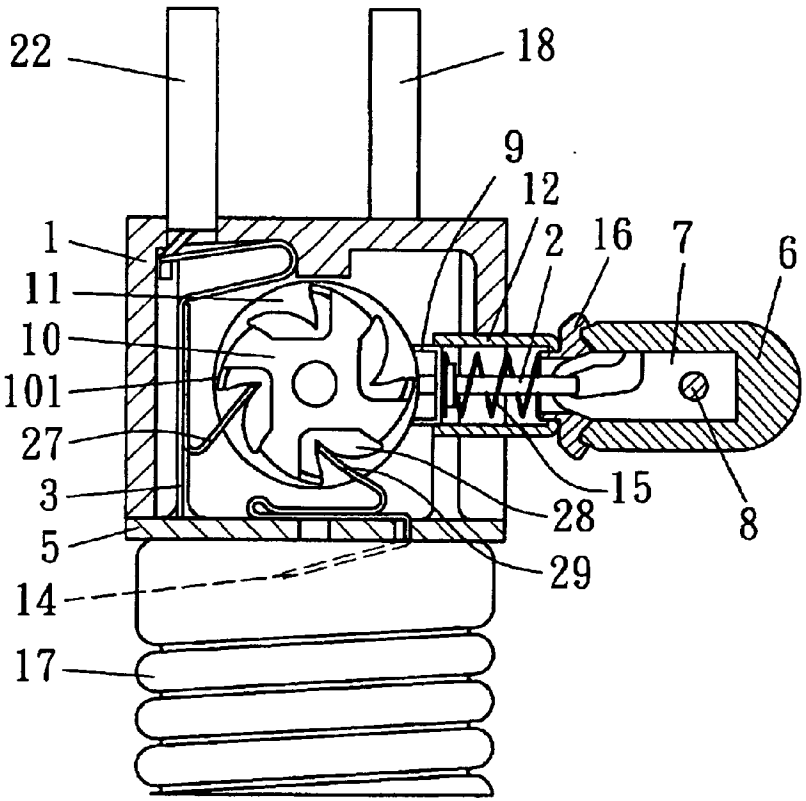
FIG. 5 is a cross-sectional view in the direction of the arrowhead marked B in FIG. 3.
Figure 4:
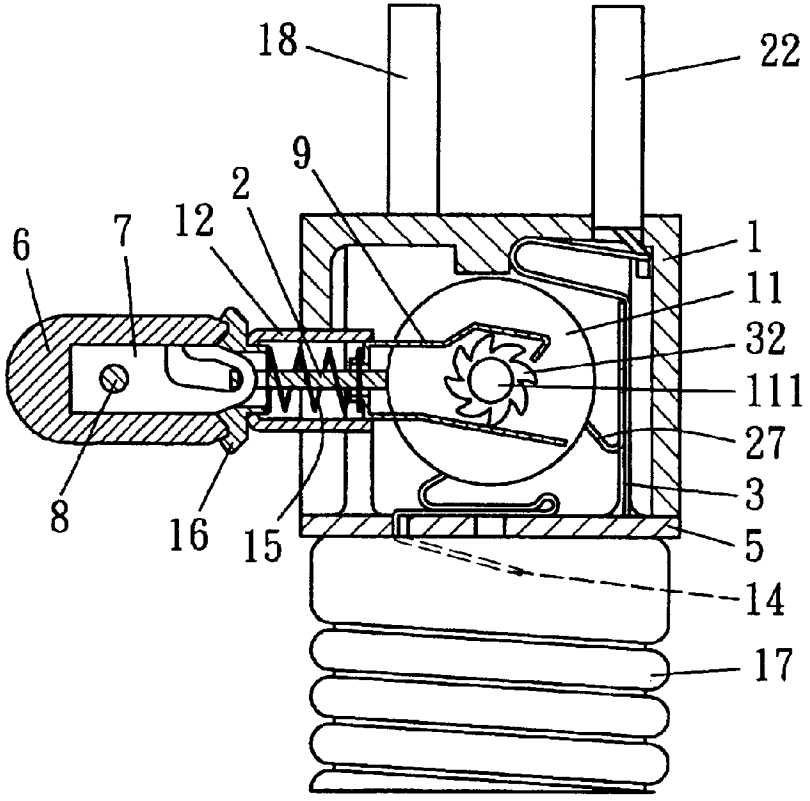
FIG. 4 is a cross-sectional view in the direction of the arrowhead marked A in FIG. 3.

In assembling, as shown in FIGS. 3, 4 and 5, the wires 18, 22 are inserted in the interior of the insulating body 1, contacting the connect ends 24, 20 of the terminals 3, 4, letting electric current to flow through the wire 18 to the terminal 4 and then to the lamp socket 1 and through the wire 22 to the elastic pressing plate 27 of the terminal 3. As the terminal 3 and the intermediate contact member 14 have their elastic pressing plates 29, 27 respectively urging the teeth of the large ratchet 28 made of insulating material, as shown in FIG. 4, so the terminal 3 is not in the through condition with the intermediate contact member 14, with the current of the wire 22 cannot reach the intermediate contact member 14. Then at the other side of he rotatable member 11, as shown in FIG. 5, the hooking member 9 does not hook the teeth of the small ratchet 32 owing to elastic push of the spring 15.

Figure 7:
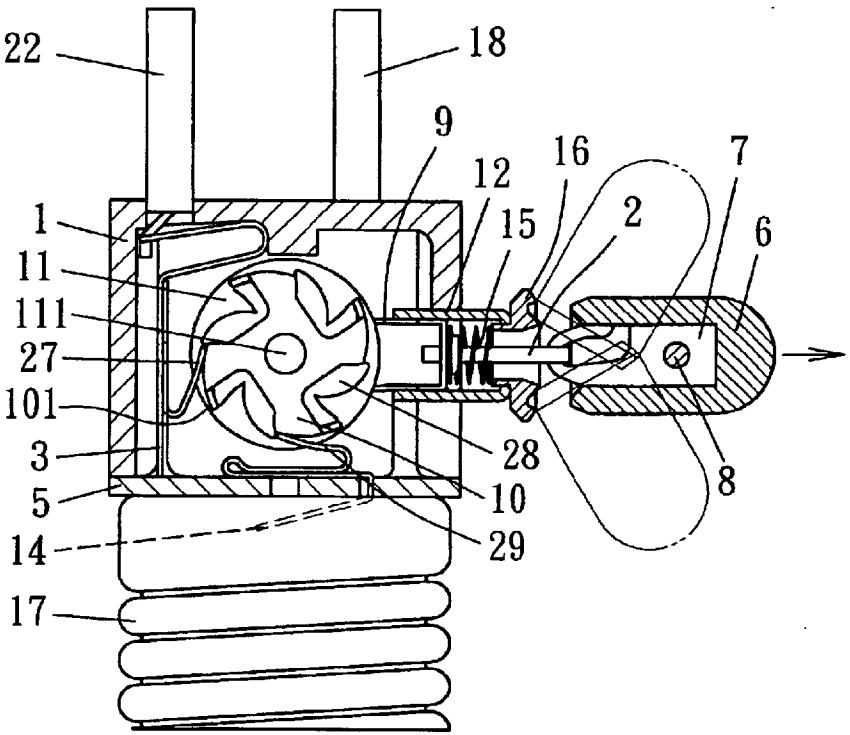
Figure 6:
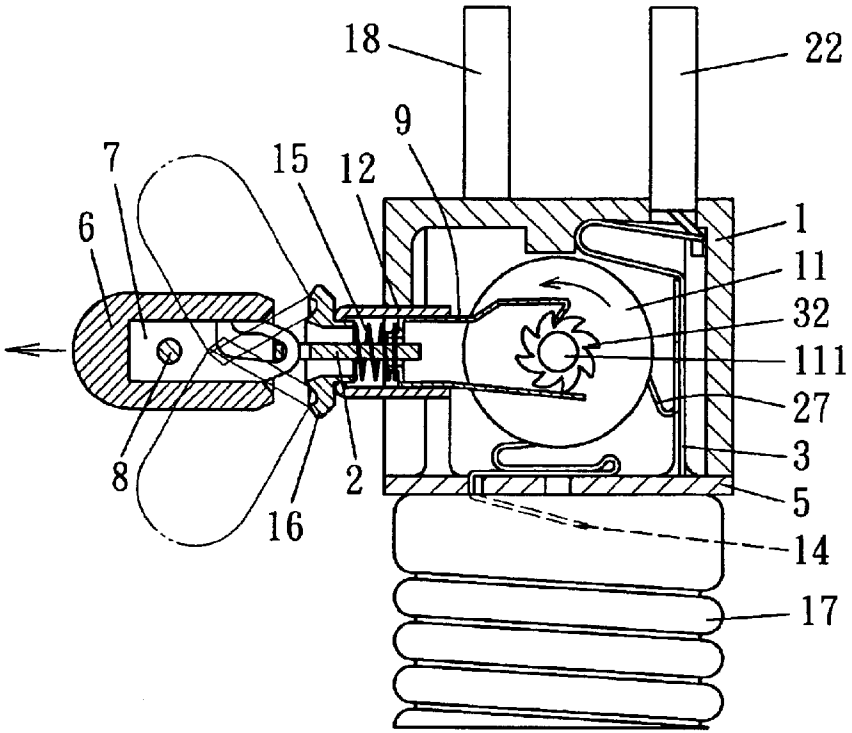
FIG. 6 is a cross-sectional view of the multi-directional grip switch lamp socket moved in the A direction shown in FIG. 3; and, FIG. 7 is a cross-sectional view of the multi-directional grip switch lamp socket moved in the B direction shown in FIG. 3.

In handling, as shown in FIGS. 6 and 7, a user only pulls the switch grip 6 outward, or bend or incline the switch grip 6 to any direcrtion (to force the switch grip 6 incline with the end of the guide ring 16 as a fulcrum), then the hook 7 may pull the pulling rod 2, which then moves the hooking member 9 laterally toward the grip 6. When the hooking member 9 moves outward, it will press the spring 15 in the fix base 12 to shrink, and the hooking member 9 also hooks and rotates the teeth of the small ratchet 32 for a set angle or the width of the ratchet tooth, or an eighth of 360 degrees (or 45 degrees). Thus if a user releases the grip 6, the spring 15 recovers its elasticity to lengthen out, pushing the hooking member 9 to retreat back to the position shown in FIG. 4, and also passing over a next tooth of the small ratchet 32.

Next, as shown in FIGS. 6 and 7, the large ratchet 28 also rotates for the set angle (or the width of its one tooth) at the same time when the small ratchet 32 rotates for the set angle. Therefore, the two elastic pressing plates 29, 27 of the intermediate contact member 14 and the terminal 3 both contact the contact strips 101 of the conductive member 10, letting the terminal 3 and the center contact member 14 electrically connected with each other, with electric current flowing through the terminal 3, the elastic pressing plate 27, the contact strip 101, the elastic pressing plate 29 and the intermediate contact member 14 to a lamp (not shown), which is then lit up. According to the design described above, whenever a user pulls or bends (inclines) the grip 6 once, the hooking member 9 rotates synchronously the small ratchet 32 and the large ratchet 28 for the set angle once, connecting electrically the contact strips 101 of the conducting member 10 with the terminal 3 and the intermediate contact member 14, or disconnect electrically by making the terminal 3 and the intermediate contact member 14 directly contact the insulated teeth of the large ratchet 28.

While the preferred embodiment of the invention has been described above, it will be recognized and understood that various modifications may be made therein and the appended claims are intended to cover all such modifications that may fall within the spirit and scope of the invention.

What is claimed is:

1. A multi-directional grip switch lamp socket comprising:

an insulating body provided with an interior hollow, said insulating body having two wire holes for inserting wires therein, two terminals positioned in said interior hollow and respectively facing to said two wire holes, one of said two terminals fixed on said lamp socket, an intermediate contact member positioned in said interior hollow and on said insulating disc and extending in said lamp socket;

a rotatable member positioned in said interior hollow of said insulating body, having a large ratchet of insulating material formed on one side, a small ratchet of insulating material formed on the other side, both said large and said small ratchet having an even number of ratchet teeth, a metal conductive member provided to fit around said large ratchet and having a half number of contact pieces as that of said large ratchet, said contact pieces spaced apart equidistantly to cover intermittently the ratchet teeth of said large ratchet, the other of said two terminals and an elastic pressing plate of said intermediate contact member elastically urging the teeth surfaces of said large ratchet or said contact pieces of said intermediate contact member;

a hooking member positioned in said interior hollow of said insulating body and facing said small ratchet on the other side of said rotatable member;

a metal lamp socket firmly connected with said insulating body;

an insulating disc positioned between said insulating body and said metal lamp socket;

a switch grip positioned laterally outside of said insulating body; and connected interactively with said hooking member;

said hooking member moved laterally toward said switch grip whenever said switch grip is pulled or bent or inclined to any direction once, said hooking member hooking said small ratchet and said large ratchet at the same time and also rotating the both for a set angle of one eighth of 360 degrees or 45 degrees, one of said terminals and said elastic pressing plates of said intermediate contact member simultaneously contacting said contact strips of said conducting member to let current flow through from a cut off condition of the switch, electric current cut off by said terminal and said elastic pressing members simultaneously contacting with the insulated teeth surfaces of said large ratchet from the turned-on condition of the switch by pulling or bending (inclining) said switch grip once more.

2. The multi-directional grip switch lamp socket as claimed in claim 1, wherein said hooking member has a through hole for a pull rod to pass through, and said switch grip has a hook, and said pull rod orderly extends through the hooking member, a spring, and a fix base and then connects with said hook of said switch grip, and therefore, said switch grip can pull said hooking member to move laterally, and can permit the hooking member to recover its position after the switch grip is released.

3. The multi-directional grip switch lamp socket as claimed in claim 1, wherein a guide ring is provided between said fix base and said switch grip.

* * * * *